United States Patent [19]

Jäger

[11] Patent Number: 4,941,384

[45] Date of Patent: Jul. 17, 1990

[54] GUITAR

[76] Inventor: Harald Jäger, Gesslerstrasse 5, D-1000 Berlin 62, Fed. Rep. of Germany

[21] Appl. No.: 320,640

[22] Filed: Mar. 8, 1989

[30] Foreign Application Priority Data

Sep. 19, 1988 [DE] Fed. Rep. of Germany ..... 3832127

[51] Int. Cl.[5] ..... G10D 3/12

[52] U.S. Cl. ..... 84/313; 84/314 N

[58] Field of Search ..... 84/267, 298, 299, 313, 84/314 N

[56] References Cited

U.S. PATENT DOCUMENTS

| | | | |
|---|---|---|---|
| 4,475,432 | 10/1984 | Stroh | 84/314 N |
| 4,512,232 | 4/1985 | Schaller | 84/313 |
| 4,632,004 | 12/1986 | Steinberger | 84/313 |
| 4,656,916 | 4/1987 | Gressett | 84/313 |
| 4,669,350 | 6/1987 | Gressett et al. | 84/314 N |
| 4,724,737 | 2/1988 | Fender | 84/313 |

FOREIGN PATENT DOCUMENTS

| | | | |
|---|---|---|---|
| 1280026 | 10/1968 | Fed. Rep. of Germany | 84/313 |

*Primary Examiner*—Lawrence R. Franklin

*Attorney, Agent, or Firm*—Millen, White & Zelano

[57] ABSTRACT

The invention relates to a guitar comprising a releasable device for clamping the strings to the nut, the ball ends being secured to a base part movable around a knife edge and disposed in a recess in the body and comprising an adjustable prism and adjustable spring riders and tension springs engaging the base part. The clamping device comprises clamping jacks (2), an adjustable end pressure plate (3) with a set screw (7) and an eccentric pressure plate (4) movable by an eccentric lever (8) and between which the strings are clamped. Also, the base part (20) has string riders (23), spacer plates (26), through bores (31) for the strings and an adjustable spring-retaining block (21) at which tension springs (39) engage, the ball ends being disposed between the through bores and the spring-retaining block. Also, the other spring ends are secured to a spring-holding bracket (35) connected to a tightening nut (40) by a spring-adjusting screw (37) with interposition of a tension casing (34) (FIG. 9).

16 Claims, 4 Drawing Sheets

GUITAR

BACKGROUND OF THE INVENTION

The invention relates to a guitar of the kind set out in the preamble of the main claim.

Guitars of this kind are basically known, e.g. from U.S. Pat. No. 4 171 661and DE-SO Nos. 33 09 217 and 33 11 277.

The known guitars have been found to have a disadvantage in that the strings are clamped by three jacks tightened by allen screws, so that the strings are pinched. When the guitar is re-turned with the strings pinched, they cannot vibrate freely and uniformly. There is also an increased risk that the pinched parts will break, particularly in the case of thin strings. It also takes time to change the strings. Finally, the known guitars require special devices for fine tuning.

SUMMARY OF THE INVENTION

According to the invention it is proposed to obviate these disadvantages by the features disclosed in the operative part of the main claim. The prevents the strings from being pinched, since the clamping pressure is distributed over a large contact-pressure surface. A string can be changed without loosening screws or removing screwable parts from the tightening system. The strings can be tuned by pegs on the pegboard as with guitars without a tremolo system. No fine-tuning devices are required. In contrast to the known systems, the distance between the place of engagement of the tension spring and the place where the string bears on the bridge formed by the spring riders is variable, so that the lever action can be improved, especially when using thicker guitar bodies.

Other advantageous features of the invention are disclosed in the sub-claims.

BRIEF DESCRIPTION OF THE DRAWINGS

The invention will now be explained in detail with reference to an embodiment of a guitar according to the invention and shown in the drawings, in which.

DESCRIPTION OF THE PREFERRED EMBODIMENT

Figure 1:
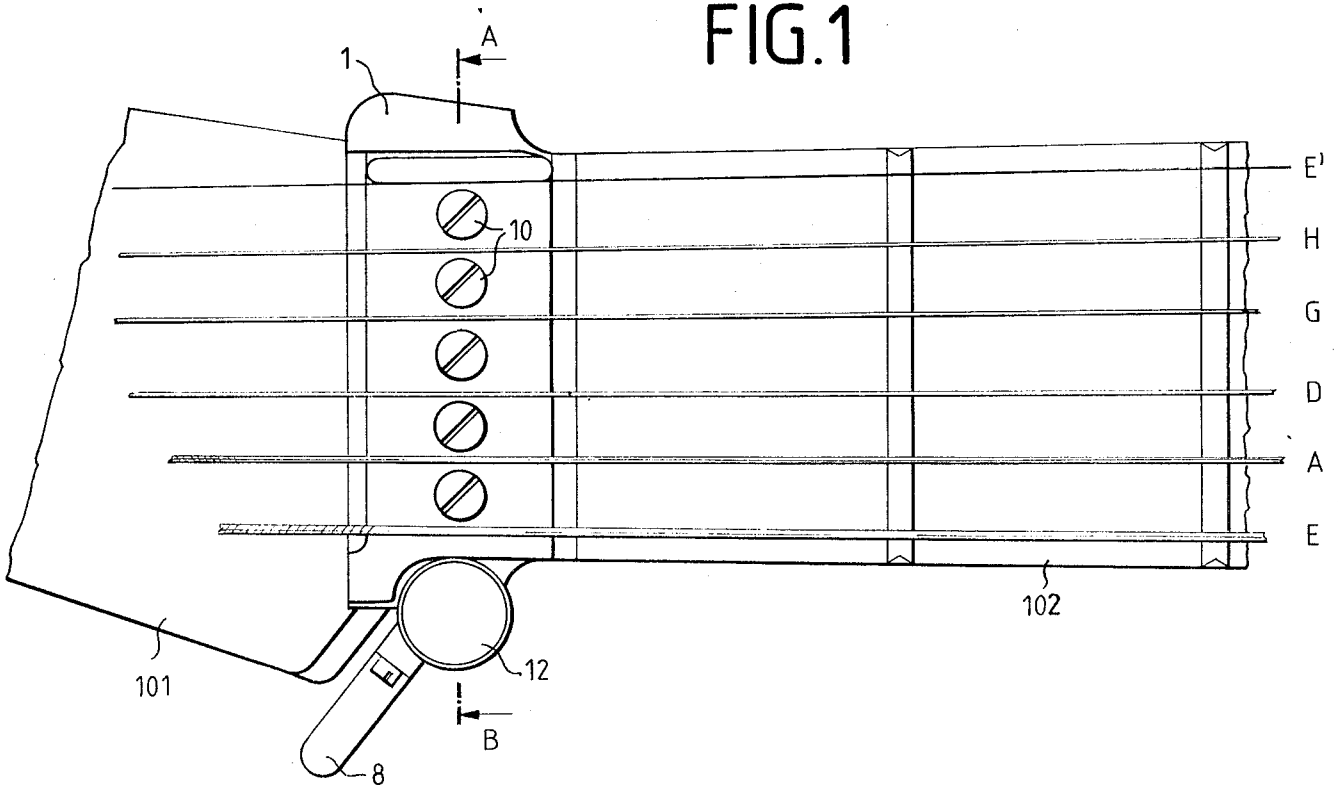
FIg. 1 is a partial plan view of the pegboard, fingerboard and nut of a guitar.
Figure 2:
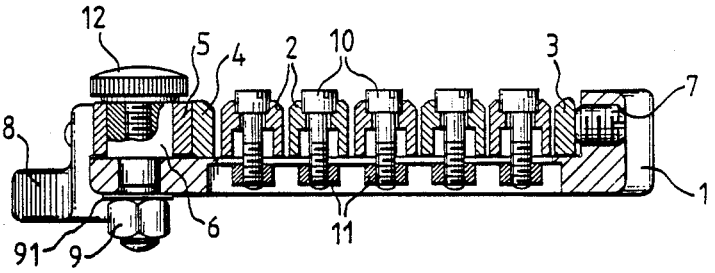
FIG. 2 is a section along line A–B in FIG. 1.
Figure 3:
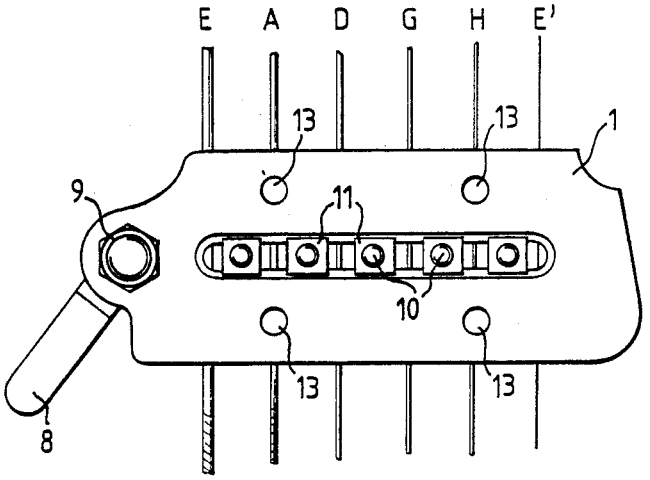
FIG. 3 is a view of FIG. 2 from beneath.

The guitar comprises a pegboard 101 with tuning pegs adjacent the nut and fingerboard 102, and also comprises a body 103 in which a base block comprising the bridge-forming string riders 23 is disposed in a recess 104. There are six strings: E, D, G, H and E'. The strings are clamped and released by actuating a tightening lever 8, which is firmly connected to a tightening eccentric 5. The tightening eccentric 5 rotates around a cylinder 6 permanently screwable into the baseplate 1.

A friction-reducing washer is disposed between the tightening eccentric and the baseplate.

A knurled-head screw 12 prevents the tightening eccentric 5 from slipping off the receiving cylinder 6.

When the strings are clamped, the eccentric 5 presses increasingly on to a pressure member 4 which in turn presses the E string, which presses the adjacent clamping jack 2 which presses the A string and so on, until the E' string has been pressed against a pressure member 3. Only slight pressure on lever 8 is necessary for this purpose. The pressure member 3 can be moved e.g. by an allen screw 7, in order to adjust the tightening travel when using thicker or thinner strings and also to adjust the strings centrally relative to the width of the neck. The clamping jacks 2 are so dimensioned in relation to one another as to allow for differences in string diameter and the slightly conical run of the strings and guarantee an equal lateral distance between all strings.

Flexible plastics screws 10 prevent the clamping jacks 2 from falling out when lever 8 is released. They also ensure that even when the strings are frequently clamped and released or when one or all strings are replaced, the clamping jacks 2 remain in the optimum position after they have once been adjusted to the thickness of the strings used.

As a result of the large tightening surface areas due to the length of the clamping jacks 2, the strings cannot be plastically deformed when the adequate tightening pressure is reached, and consequently the strings cannot be mis-tuned by the tightening process and there is no need of additional tuning by fine tuning device. Also some or all the strings can be re-tuned to a different key. This would be impossible if clamping resulted in deformation of the string cross-section.

Let us take the case for example of a studio production in which all the instruments are on tape and only the guitar part has to be recorded. For technical production reasons the concert pitch A=440 Hz is raised to e.g. 443 Hz. By means of the invention, an experienced guitarist needs about 2 or 3 minutes to adjust to the situation.

The tuning-up increases the tension on the strings, with the result that the tremolo block would move so that the strings would shorten. This would shorten the distance between the nut and the bridge, so that the instrument would no longer be true to the frets. The required higher spring tension can be set by a tightening nut 40.

The string clamping jacks 2 can be moved sideways by square nuts 11. Bores 13 are screwing the string nut to the pegboard of the guitar. The tremolo block, which is disposed in a recess 104 in body 103, basically consists of a base part 20 and an adjustable spring-retaining block 21.

Figure 9:
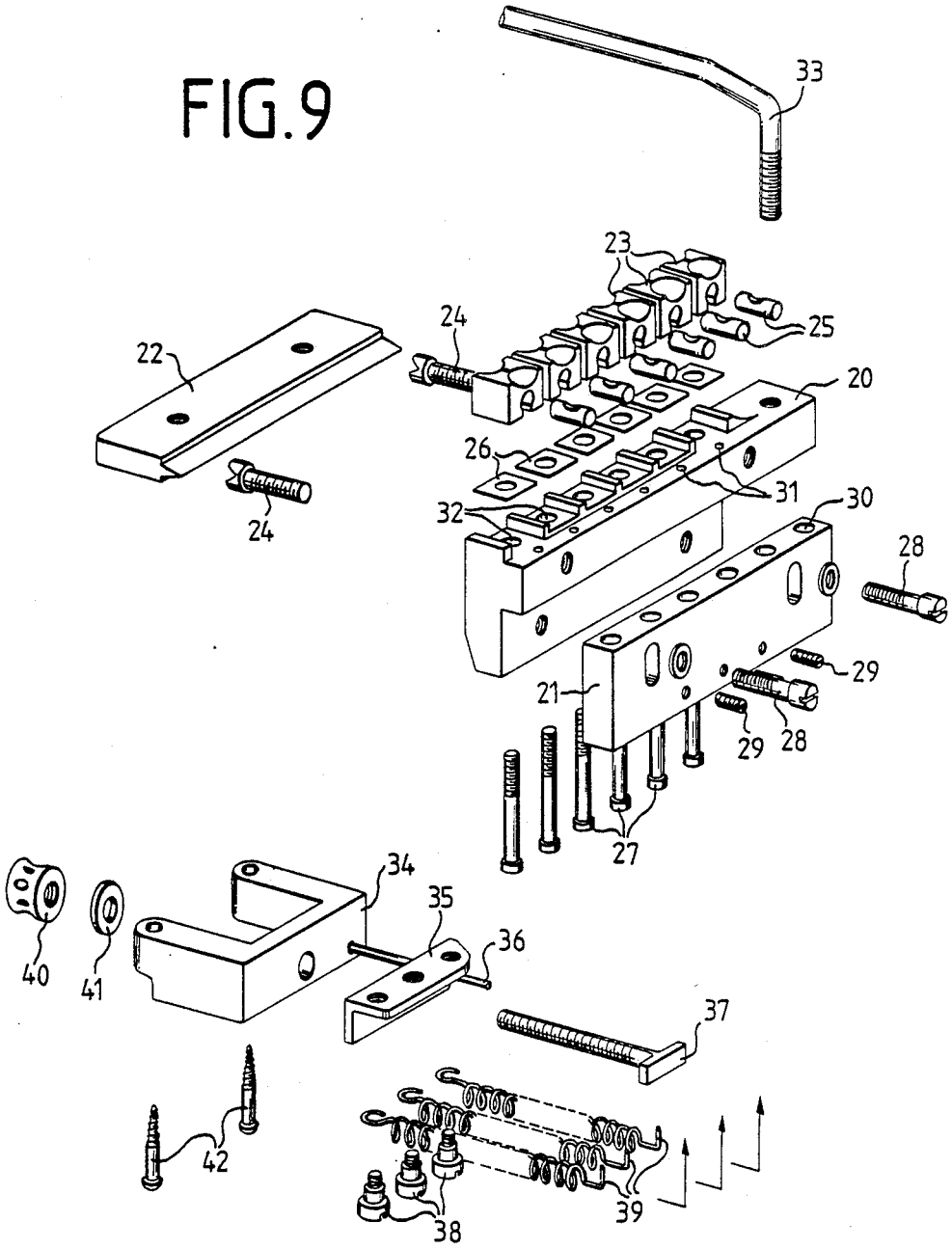
FIG. 9 is an exploded view of FIG. 5.

Prisms are disposed on the base part 20 and are engaged by a knife edge 22, thus producing the pivot for the movable base part. The prisms can be disposed either on the head of screws 24 or alternatively can be formed in cylinders vertically movable in the base part. String riders 23 constituting the bridge are disposed on the base part 20 and are adjustable both vertically and lengthwise, i.e. in the direction of the strings. The spring-retaining block 21 is adjustably connected to the base part 20 and the spring set engages its under-part. Transversely-threaded tightening cylinders 25 are for firmly screwing the string riders to the base part 20, and spacer plates 26 are for correcting the position of the strings. Tightening screws 27 engage in the tightening cylinders 25, through spacer plates 26 and bores 32 in base part 20. The base part 20 also has through bores 31 for the strings, whereas the spring-retaining block 21 has through bores 30 for the ball ends. Details can be seen particularly in FIG. 9. The set of springs comprise three springs 39 having end hooks secured by grub-screws 29 in the spring-retaining block. At the other end, the springs are secured by shoulder attachment screws to a spring-retaining bracket 35, which is connected to a tightening casing 34, preferably of brass, by a spring-tension adjusting screw 37. A plastic pin 36 prevents bracket 35 from rotating when screw 37 is adjusted by rotating a tightening nut 40, which is disposed on screw 37 with interposition of a plastics friction-reducing washer 41. By means of wood screws 42, the tightening casing 34 is secured in body 103 so as to be flush with the recess 104.

Figure 7:
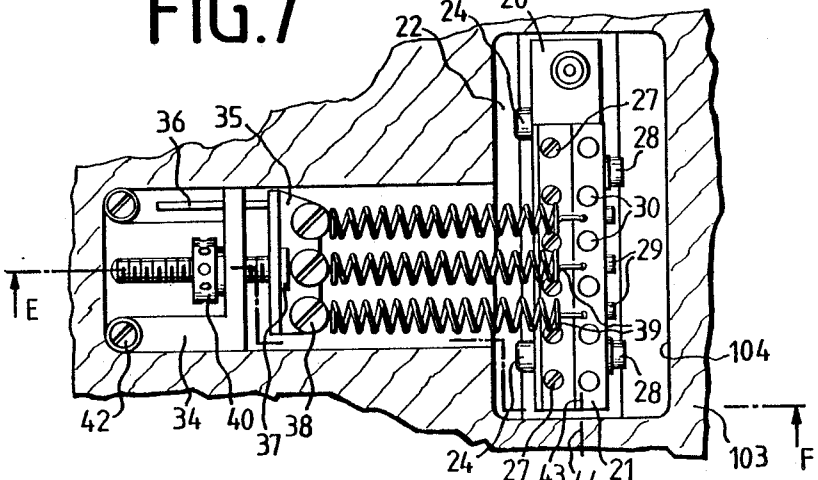
FIG. 7 is a view of the underside of FIG. 5 with a spring-tightening device.
Figure 8:
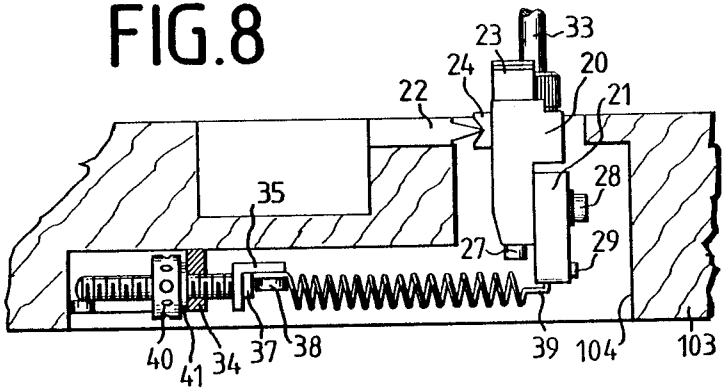
FIG. 8 is a section along line E–F in FIG. 7.
Figure 6:
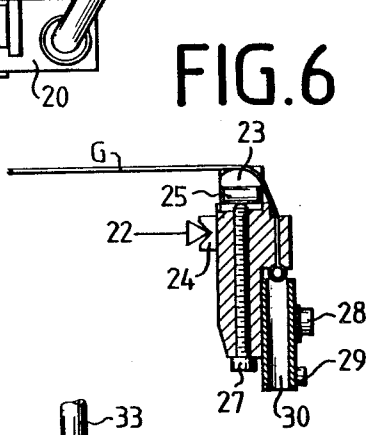
FIG. 6 is a section through FIG. 5 along line C–D with the G string positioned and anchored.
Figure 4:
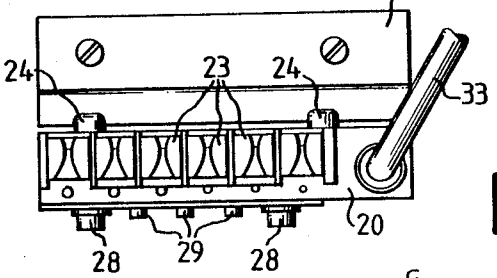
FIG. 4 is a plan view of the bridge or tremolo block of a guitar.
Figure 5:
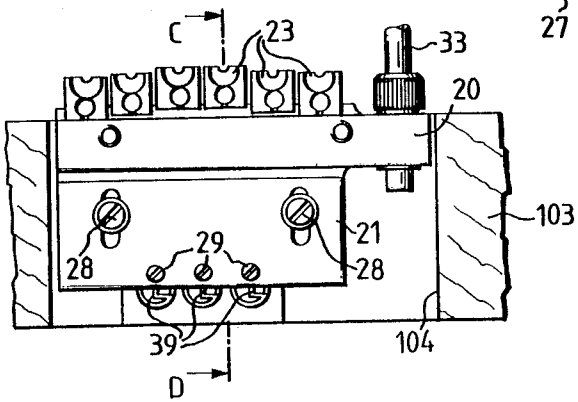
FIG. 5 is a back view of FIG. 4 with a recess in the body.

A calibration line 43 is drawn on the underside of the spring-retaining bracket 21. There is a similar calibration line 44 on the underside of body 103. When the two lines coincide, the guitar is in the state where the frets are true. When the two lines 43 and 44 coincide at a desired tuning (see FIG. 7) the place can be marked on the tightening nut 40, so that when the tuning is repeated (if the guitar has been re-tuned meanwhile) it is only necessary to set the tightening nut 40 in the marked position. The strings are correspondingly tuned upwards or downwards so that the tremolo block returns to the zero position, i.e. when the calibration lines coincide, the tremolo block in side view is exactly perpendicular, the guitar is correctly tuned and the frets are true without deviation. The spring-clamping device is then tightened by lever 8.

When the tremolo block is constructed in this manner, the distance between the place of engagement of the tension springs 39 and the place where the strings bear on the riders 23 is variable, so that the lever action can be improved, particularly when using thicker guitar bodies. The same purpose is also served by the cylinders screwable if required into the base part 20 and having prisms engaging the knife edge 22.

The tremolo block can be moved by a lever 33 in two directions. When the lever is pressed down, the distance between the nut and bridge (string riders 23) is shortened, i.e. the pitch is lower and the string tension is reduced. If the lever is pulled in the opposite direction the pitch is raised. The distance between the two string-bearing points becomes greater and the string tension increases.

When the lever 33 is released, the tremolo block is automatically pulled back into the zero position. Losses due to friction are advantageously kept at a minimum for this purpose. The two prisms are centered on the knife edge 22 and constitute the pivot. The prisms and consequently the entire block are prevented from lateral shifting by the engaging forces of the conical run of the strings and the central set of springs. After once being correctly adjusted, the "block" (23–32 in FIG. 9) is only a moving part and forms a homogeneous unit.

During re-tuning, blind bores on the periphery of the tightening nut 40 facilitate adjustment to the markings there. The set of springs can be tightened or loosened externally through the cover plate without removing it. The distance from the pivot of the knife edge 22 to the string support and also the distance from the pivot to the spring-retaining point form a variable lever, owing to the mobility of the prisms on the one hand and the adjustable spring-retaining block 21 on the other hand.

The longer the lever, the smaller the spring tension required and the smoother the tremolo system. Via the two levers, the string tension and the spring tension are exactly compensated and guarantee the zero position after release of lever 33. Since the string-clamping system is easy to manipulate, no fine-tuning devices are needed.

What is claimed is:

1. A guitar comprising a releasable device for clamping the strings to the nut, the ball ends being secured to a base part movable around a knife edge and disposed in a recess in the body and comprising adjustable string riders and tension springs engaging the base part, characterised in that (a) the clamping device comprises clamping jacks (2), an adjustable end pressure plate (3) with a set screw (7) and an eccentric pressure plate (4) movable by an eccentric lever (8) and between which the strings are clamped;

(b) the base part (20) has string riders (23), spacer plates (26), through bores (31) for the strings and an adjustable spring-retaining block (21) at which tension springs (39) engage, the ball ends being disposed between the through bores and the spring-retaining block, and a prim is provided and is adjustable in position;

(c) the other spring ends are secured to a spring-holding bracket (35) connected to a tightening nut (40) by a tension-adjusting screw (37) with interposition of a tension casing (34).

2. A guitar according to claim 1, characterised in that the spacing between the clamping jacks (2) corresponds to the differences in thickness in the strings runing between them, their sides facing the strings are adapted to the conical shape of the strings, and they are firmaly screwed to the baseplate (1) with the distance between the string tangents being the same between all the strings.

3. A guitar according to claim 2, characterised in that a calibrating line (43, 44) is disposed on the underside of the spring-retaining block (21) and the underside of the body (103) respectively.

4. A guitar according to claim 1, characterised in that a tightening eccentric (5) is rotatably mounted on a receiving cylinder (6) anchored in the baseplate (1).

5. A guitar according to claim 3, characterised in that a friction-reducing washer is provided between the tightening eccentric (5) and the baseplate (1).

6. A guitar according to claim 3, characterised in that the tightening eccentric is secured to the receiving cylinder (6) by a knurled-head screw (12).

7. A guitar according to claim 1, characterised in that the string riders (23) are secured to the base part (20) with interposition of spacer plates (26) and tightening cylinders (25) with tightening screws (27).

8. A guitar according to claim 7, characterised in that two prisms are movable disposed in the base part (20), and a knife edge secured to the body (103) engages in the prisms.

9. A guitar according to claim 8, characterised in that the prisms are axially movable in a locating bore vertically and are lockable in the required position by respective allen screws in the base part.

10. A guitar according to claim 7, characterised in that the prisms are secured in the head of screws (24) disposed in the base part (20).

11. A guitar according to claim 7, characterised in that the spring-retaining block (21) is vertically adjustable on the base part (20) and has setscrews (29) into the tension springs (39) can be hooked.

12. A guitar according to claim 11, characterised in that the ends of the tension springs (39) remote from the hooks are secured to a spring-holding bracket (35) by shoulder-attachment screws (38).

13. A guitar according to claim 11, characterised in that the spring-retaining bracket (35) is connected by a spring-tension adjusting screw (37) to a tightening casing 34 secured to the body (103).

14. A guitar according to claim 13, characterised in that a tightening nut (40) with peripheral blind bores is secured with interposition of a friction-reducing washer (41) to the free end of the spring-tension adjusting screw (37).

15. A guitar according to claim 13, characterised in that a retaining pin (36) holds the tightening casing (34) in position relative to the spring-holding bracket (35).

16. A guitar according to claim 6, characterised in that the spring-retaining block (21) has through bores (30) for the ball ends.

* * * * *